US006796452B2

(12) United States Patent
Petzitillo, Jr. et al.

(10) Patent No.: US 6,796,452 B2
(45) Date of Patent: Sep. 28, 2004

(54) WASTE CONTAINER WITH DISPLACEABLE PANEL CLOSURE

(75) Inventors: Anthony D. Petzitillo, Jr., Sicklerville, NJ (US); Todd A. Fowler, Blackwood, NJ (US)

(73) Assignee: Wastequip Manufacturing Company, Erial, NJ (US)

( * ) Notice: Subject to any disclaimer, the term of this patent is extended or adjusted under 35 U.S.C. 154(b) by 0 days.

(21) Appl. No.: 10/454,717

(22) Filed: Jun. 4, 2003

(65) Prior Publication Data

US 2003/0192900 A1 Oct. 16, 2003

Related U.S. Application Data

(63) Continuation of application No. 10/079,287, filed on Feb. 20, 2002, now Pat. No. 6,732,883, which is a continuation-in-part of application No. 09/698,976, filed on Oct. 27, 2000, now Pat. No. 6,364,153.

(51) Int. Cl.[7] ..... B65D 51/24
(52) U.S. Cl. ..... 220/378; 220/849
(58) Field of Search ..... 292/338; 220/378, 220/849, 1.5, 810, 845

(56) References Cited

U.S. PATENT DOCUMENTS

| | | | | |
|---|---|---|---|---|
| 2,318,151 A | * | 5/1943 | Gary | 220/324 |
| 2,338,477 A | | 1/1944 | Wolters et al. | |
| 2,758,477 A | | 8/1956 | Spindler et al. | |
| 3,701,452 A | * | 10/1972 | Tonn | 220/378 |
| 4,821,902 A | | 4/1989 | May | |
| 4,853,985 A | | 8/1989 | Perry | |
| 4,878,596 A | | 11/1989 | Cawley et al. | |
| 4,934,562 A | | 6/1990 | Early et al. | |
| 5,251,775 A | | 10/1993 | Kruzick et al. | |
| 5,533,643 A | | 7/1996 | Kruzick | |
| 5,639,129 A | | 6/1997 | Lindley | |
| 5,755,351 A | | 5/1998 | Kruzick | |
| 6,364,153 B1 | | 4/2002 | Petzitillo, Jr. et al. | |

* cited by examiner

*Primary Examiner*—Stephen Castellano
(74) *Attorney, Agent, or Firm*—Duane Morris LLP

(57) ABSTRACT

A container with side and end walls, a top and a bottom, has a closure with a panel movable outwardly perpendicular to a plane of the closure, from a closed and substantially sealed position to a closed and substantially unsealed position to disengage the seal before undertaking a more gross opening movement in which the panel is moved clear of the opening. In one embodiment, a container is provided with a rear or end wall that in its gross movement hinges open and closed to clear or close an opening between container side walls. At least two hinges are mounted between the movable rear wall and a support plate on a sidewall adjacent to the movable rear wall. The support plate is constrained to move perpendicular to the plane of the door opening, shifting the rear wall between a closed and substantially sealed position and a closed and substantially unsealed position. In this manner the seal is subjected only to compression and decompression, with the movable rear wall or top lid in each case being free move open or closed without interference with the seals. A container door stop assembly and pressure release assembly are also provided.

4 Claims, 17 Drawing Sheets

WASTE CONTAINER WITH DISPLACEABLE PANEL CLOSURE

This is a continuation of U.S. patent application Ser. No. 10/079,287, Feb. 20, 2002 now U.S. Pat. No. 6,732,883, which is itself a continuation-in-part of U.S. patent application Ser. No. 09/698,976, titled WASTE CONTAINER WITH DISPLACEABLE PANEL CLOSURE, filed Oct. 27, 2000, and now issued as U.S. Pat. No. 6,364,153.

FIELD OF THE INVENTION

The invention relates to containers for cargo such as bulk waste material, especially intermodal containers, and more particularly concerns a container having a closure mechanism with a panel mounted for displacement perpendicular to the plane of the closure, in addition to being mounted for hinging or sliding, to facilitate sealing.

BACKGROUND OF THE INVENTION

Bulk materials, finished products, parts and components, and also waste materials are frequently transported in large containers that preferably seal tightly when closed. Although there are a number of standard sizes, particularly for intermodal containers, a typical container is approximately twenty feet long, six to eight feet wide and four to twelve feet deep.

Such containers advantageously are openable at the top to facilitate loading and unloading. U.S. Pat. No. 5,533,643—Kruzick, for example, discloses a box-like container having a movable top panel or lid that covers an opening occupying a large portion of the top. The lid can be displaced to either side of the container on a roll track, and upended. When closed or moved over the opening, clamps permit the lid and the roll track to be pulled down against the container against spring pressure, for compressing a resilient seal around the perimeter of the opening.

Another container structure is disclosed in U.S. Pat. No. 5,639,129—Lindley, wherein the top of the container is open but an end door provides an alternative path for loading, as well as dumping of the contents by tipping the container at an appropriate site to discharge the contents through the end. The door defines one full end of the container and is attached to the ends of the opposite side walls on a vertical hinge at the end of one side wall, and a latching mechanism at the other side wall.

Containers as described may be subject to very rough handling and must be of a sturdy construction. The two containers cited above are structured much like dumpsters in that they can be pulled onto a carrying vehicle having a ramp or tiltable flat bed, or urged onto a vehicle by backing a tilting support under a container held at a stop. Such containers are frequently pushed about. They may be handled with fork trucks and are sometimes dropped or at least set down very hard in handling. Materials may be dumped violently into the containers when loading. During normal use, damage and misalignment can occur, particularly in the lids and doors, and their associated seals. Damage to the lids, doors or their seals can result in leakage from the container, and ingress of water.

Containers may be designed with standardized fittings that enable alternative ship, rail and road transport. The fittings are positioned to be engaged by standard locating and fixing pins or hooks of a container in a staging area or on a vehicle placed at a defined position. To support the container when moved from a vehicle to the ground, and vice-versa, the container may have slide runners or rails along the bottom or roll-off hoist structures such as undercarriage wheels. For applying the necessary lateral force via a cable, chain or grasper, a post or hook can be secured to the frame or undercarriage of the container, to receive a hook or cable bight, etc.

Whether the container is structured to be moved in one way or another, moving the container, as well as loading and unloading the container, may generate considerable internal force and stress. The container is most capable of resisting forces that might deform the container if the walls and joints of the container are continuous and well braced. The container is vulnerable to deformation to the extent that closures are provided because the closures are discontinuities in the structure of the container. With respect to loading and unloading, the closure areas are also vulnerable to being struck with falling material or bumped and banged by loading and unloading manipulators.

Where a container closure encompasses a structural wall of the container such as the end wall in the Lindley container mentioned above, the closure must be as heavy and durable as a structural wall, and should be mounted to provide secure mechanical connections of the closure panel with the container structures adjacent to each opening. The container closure also needs to maintain an adequate seal, for example a watertight seal. Often, the objects of providing a heavy closure are inconsistent with the need to provide a good seal.

In the case of a container used for potentially hazardous waste, it is particularly important that the door and lid be sealed in a manner that will not permit accidental seepage of the contents. However, for contents that are not generally considered hazardous, a seal may also be important to prevent water from gaining ingress and damaging the contents. For some materials, water in the container may leach chemical agents from the contents, and the leachate can be a problem.

Large waste containers preferably are transportable by rail if desired, where maximum container height limits are set by federal regulations. Height regulations also apply to over-the-road transport. In addition to the foregoing considerations or mechanical strength and effective sealing, it is desirable that any top lid cover the entire top opening in one piece. It is desirable that the lid and the mechanism for supporting the container lid project above the container as little as possible. Another advantageous aspect would be to provide a lid mechanism that can be handled by a single person.

Containers with end door closures are dumped by opening a door at one end of the waste container, and raising the other end of the container so that the contents slide through the open door by gravity. Dumping containers often have a horizontal hinge at the top of a pivoting door panel, which structure is useful in that the hinge mounting structurally supports the container by fixing the distance between the sidewalls adjacent to the door. However, such a door interferes with access for loading and unloading through the end. In the Lindley container, the hinge axis is vertical. The door is hinged to one of the container sidewalls and is latched to the other. This arrangement places substantial stress on the hinge-side container sidewall. The weight of the door is cantilevered. When the door is pivoted to or near to the closed position, the weight of the door produces a force tending to sway the container hinge axis inwardly and cause the door to droop across the opening. As the door is swung open or closed, the direction of the swaying force varies, stressing the side wall. When the door is closed, it is necessary for the latch side to engage securely to support the weight of the door.

Moreover, the relative movement of a vertically hinged door panel wears the seals. Releasing the latching engagement of the door can result in damage to the seal as the disengaged door panel drops downwardly around a point at the bottom of the door hinge axis. As the door drops at the latch side, the portions of the door and container defining the seal grind over one another in the plane of the end opening. Such grinding wear on the seal is difficult to avoid. Even if the vertically hinged door does not droop at all, the motion of the door panel is rotational about its hinge axis. Rotation around the hinge axis translates into at least a slight relative displacement in the plane of the opening, namely displacement of the door panel relative to a seal strip on the ends of the container side walls (or vice versa) as the seal is compressed. The relative motion is perpendicular to the opening only at the precise point at which the door panel is at the nominal closed position, typically perpendicular to the container side wall. The seal is engaged by the door panel over an arc of the door panel as the door panel contacts and then compresses the seal, which grinds at the seal.

There is a need for a simple, durable and reliable mechanism for permitting the cover or lid of a large container to be easily manipulated between a locked and sealed position and an open position clear of the corresponding container opening, while optimizing sealing. There is also a need for a relatively durable end closure that can provide a reliable seal in a variety of conditions and which is easily used without normal operation causing undue wear on the seal.

SUMMARY OF THE INVENTION

According to an inventive aspect, a container that comprises a plurality of sidewalls, a top and a bottom, is provided with a sealing closure in at least one of the walls or portion of the top, comprising a door or panel that is mounted for movement perpendicularly inwardly and outwardly of the closure plane, for moving between a closed-but-unsealed position and a closed-and-sealed position, and additionally is provided with a gross mounting structure for moving the door or panel more generally from the closed-but-unsealed position to an open position substantially clear of the opening.

In one embodiment of the invention, a container is provided that comprises sidewalls, a bottom wall, and a top wall defining an opening. A movable lid that is sized to cover and sealingly close the opening is positioned upon the top wall. At least two guides are positioned on the top wall adjacent to the opening, spaced apart from one another and movable between a first position and a second position. A carriage is mounted on the lid which rides upon the guides wherein the guides and the carriage cooperate to enable the lid to move between (i) a closed and substantially sealed position corresponding to the first position of the guides and (ii) a closed and substantially unsealed position corresponding to the second position of the guides wherein the lid is free to be slid upon the guides. The lid can slide or roll on the guides, and preferably is carried on rollers that are captive in the guides, above and below, and permit the lid to be moved to either side and upended to open the container. Preferably, the guides are displaceable perpendicularly toward and away from the plane of the closure, such that the lid is either pulled down onto container seals or lifted from the seals for movement without interference with or from the seals.

In another embodiment of the invention, a container is provided that comprises a plurality of walls bounding a volume wherein one of the walls defines a door panel that is movable so as to define an opening into the volume. At least two hinges are mounted between the door or movable sidewall and a support plate, and enable displacement of the hinge axis along a line perpendicular to the closure plane of the opening. The support plate is located on a sidewall adjacent to the movable sidewall or door, and is movable between a first position and a second position thereby enabling the movable sidewall to shift between (i) a closed and substantially sealed position corresponding to the first position of the support plate and (ii) a closed and substantially unsealed position corresponding to the second position of the support plate.

The lid in the first embodiment and the movable sidewall or door in the second embodiment are independently movable toward and away from the closure plane to engage or disengage the seal, and via their respective guides or hinges to clear the opening in a manner that does not interfere with the seal.

In a further embodiment of the invention, a container is provided having walls and an open end defined by edge portions of the walls, and a moveable rear wall that has a peripheral frame mounted on the container adjacent to the edge portions so as to sealably engage and disengage the edge portions. An adjustable door stop assembly is mounted to a portion of the door, and includes a first stop blade fixedly positioned on the peripheral frame and a second stop blade removably fastened to the first stop blade. In this way, when the moveable rear wall is arranged in a first sealed engagement with the edge portions, the second stop blade engages the edge portions; and when the second stop blade is unfastened and removed from the first stop blade and then the moveable rear wall is arranged in a second sealed engagement with the edge portions, the first stop blade engages the edge portions.

In yet another embodiment of the invention, a pressure release assembly for use on a container is provided including a vent panel sized so as to be mounted within a wall of the container so as to allow for air flow communication with an interior volume. A cover plate is arranged in spaced relation to the vent panel so as to define an enclosed void space therebetween. A flapper assembly is positioned in the void space, and includes a flapper-plate pivotally mounted on the wall of the container so as to define an entrance into the void space. In this way, when a differential in air pressure exists between the interior volume of the container and the ambient environment outside of the container, the flapper-plate pivots between a closed and substantially sealed first position and an open second position.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
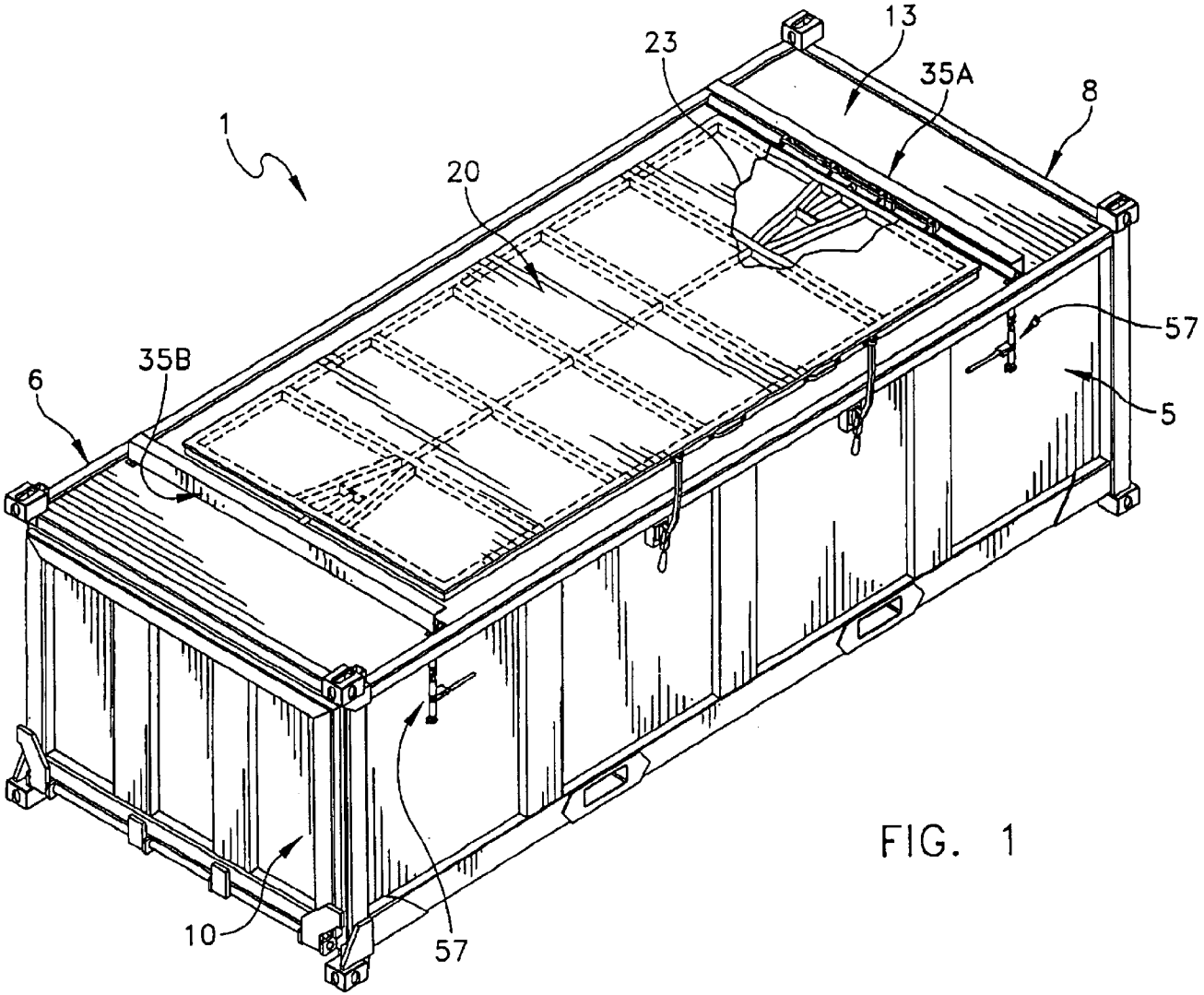
FIG. 1 is a perspective view of a container formed in accordance with the present invention.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

FIG. 1 shows an inventive container 1, comprising side walls 5 and 6, a front wall 8, a rear wall 10, a top wall 13 and a bottom, all of which are arranged so as to enclose a void space or volume that is sized and otherwise outfitted for storing or transporting various materials or items, such as bulk materials, finished products, parts and components, waste materials and the like. The container is particularly apt for storing materials or items that are advantageously isolated in the volume by seals.

Figure 5:
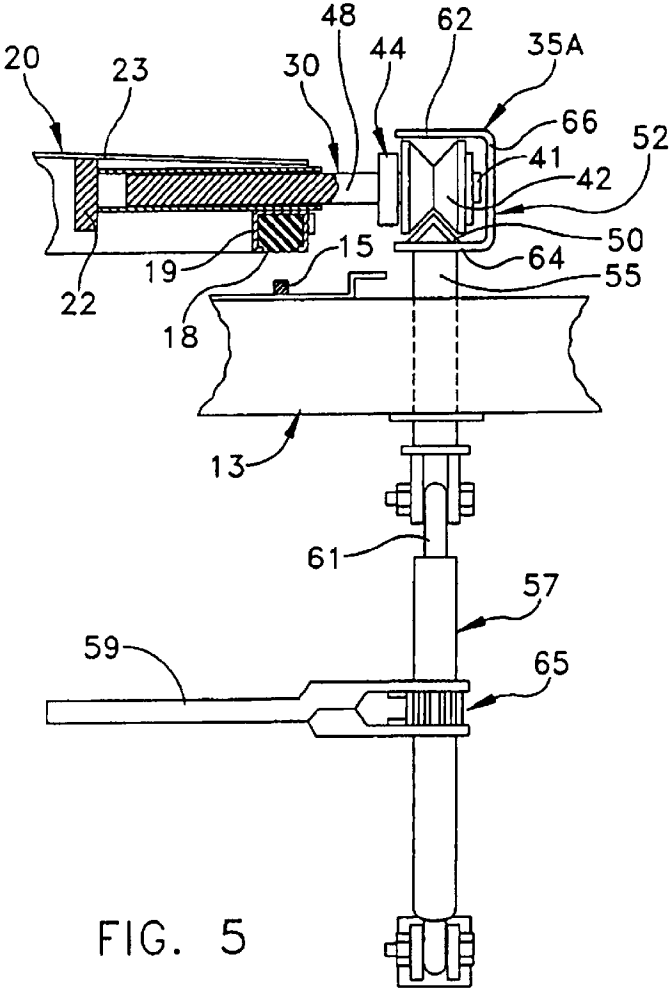
FIG. 5 is a broken-away, front elevational view of a ratchet binder of the type used in connection with the present invention, shown in a second position.
Figure 4:
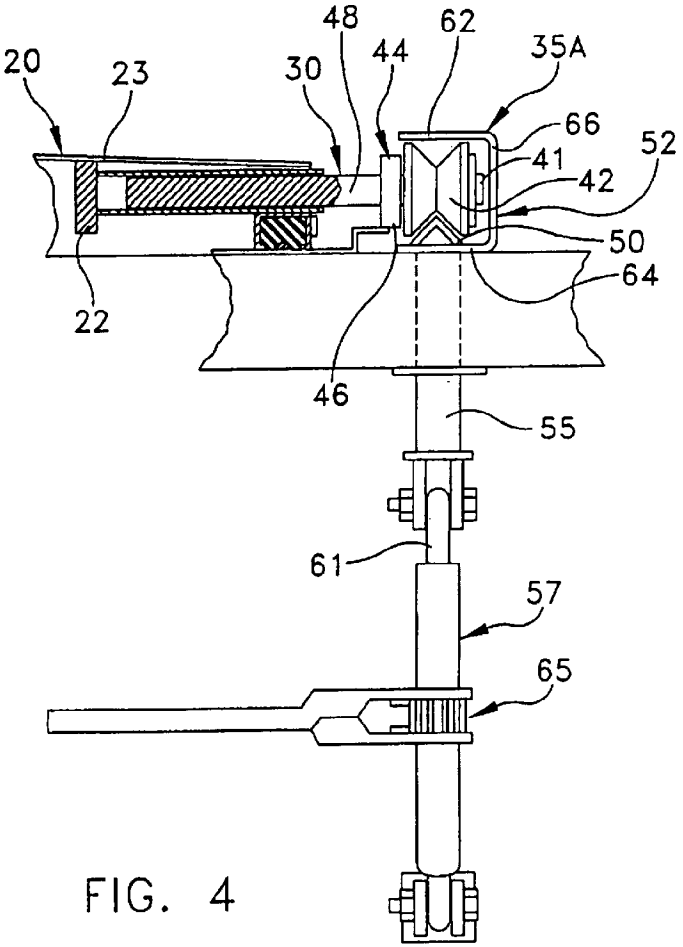
FIG. 4 is a broken-away, front elevational view of a ratchet binder of the type used in connection with the present invention, shown in a first position.
Figure 6:
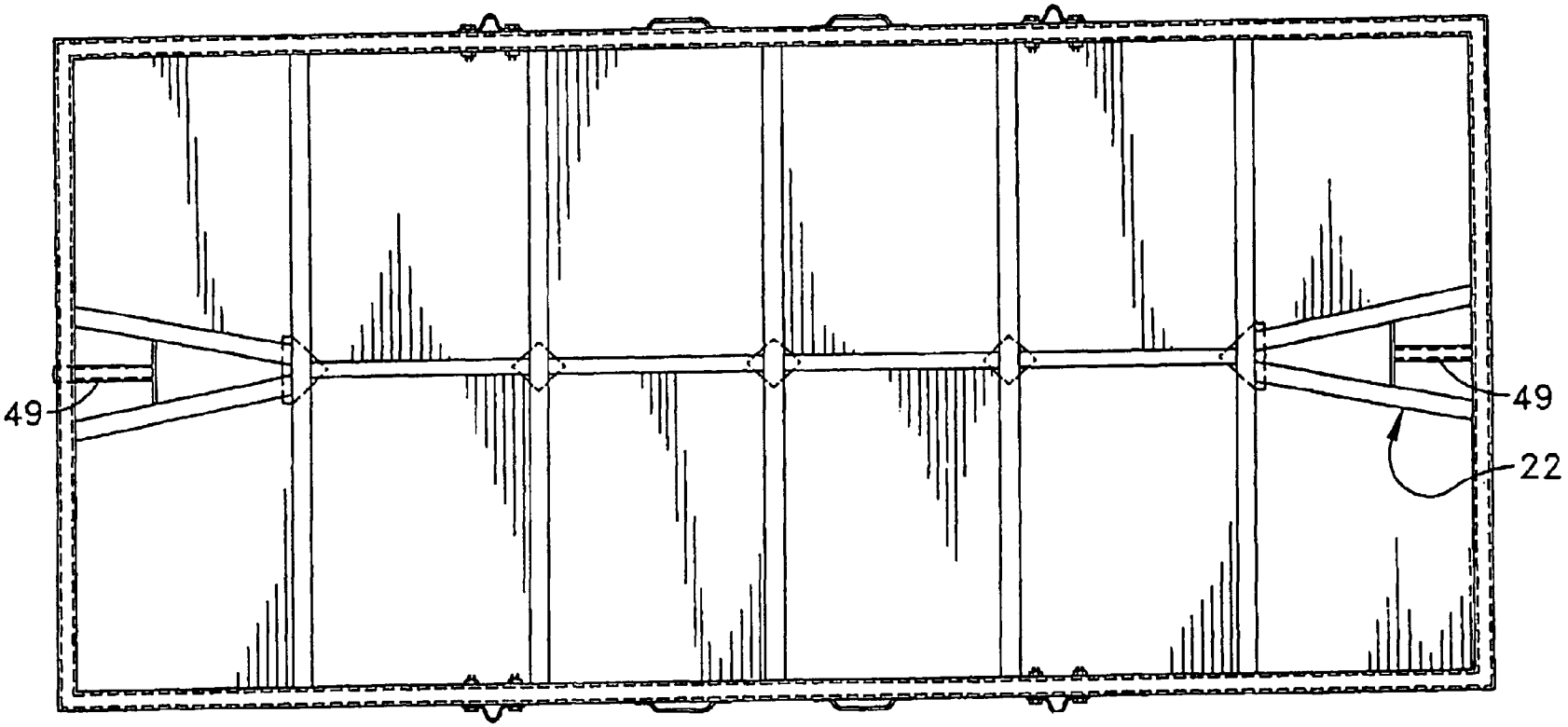
FIG. 6 is a bottom view of a lid used in connection with one embodiment of the present invention.
Figure 7:
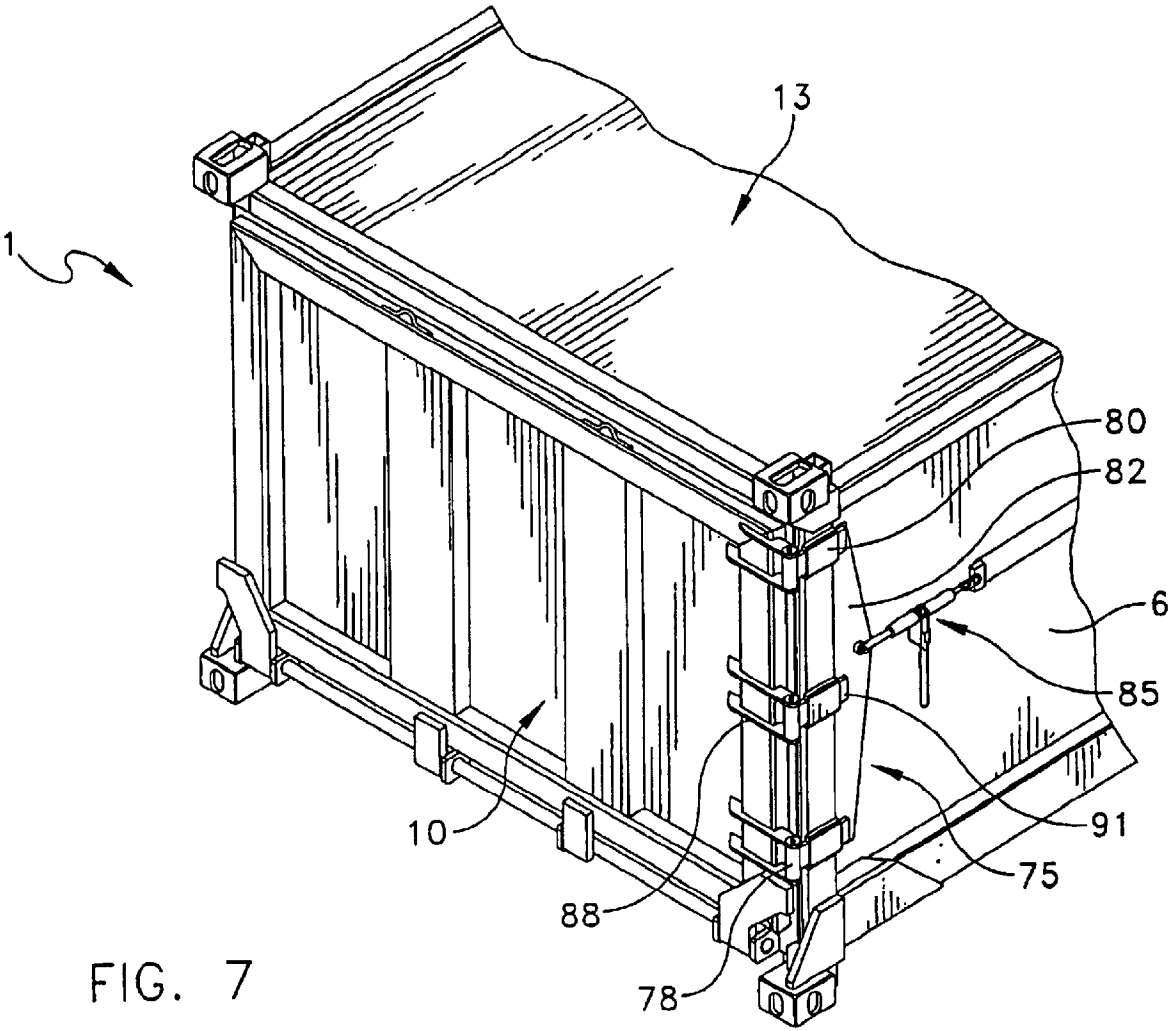
FIG. 7 is a broken-away, perspective end view of a container formed in accordance with another embodiment of the invention.
Figure 8:
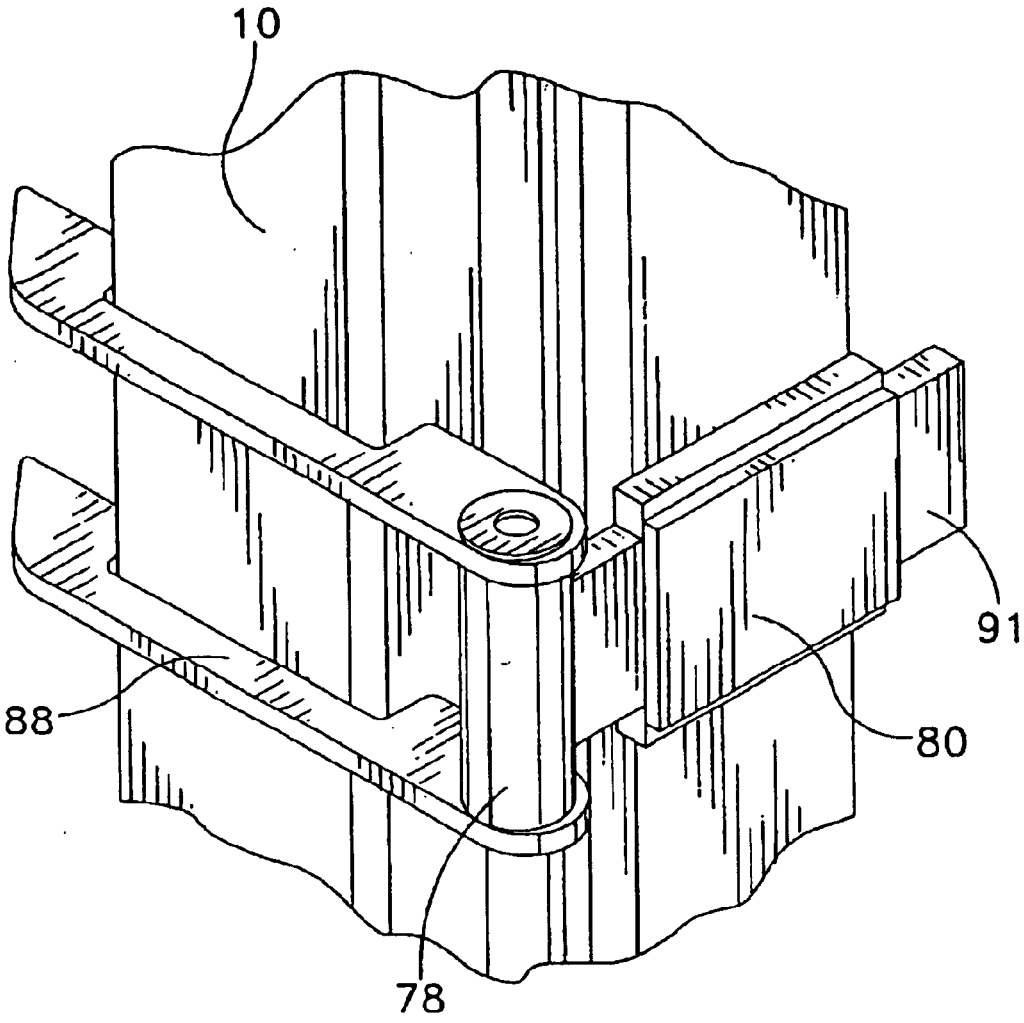
FIG. 8 is a broken-away, perspective view of a hinge and hinge guide.
Figure 9:
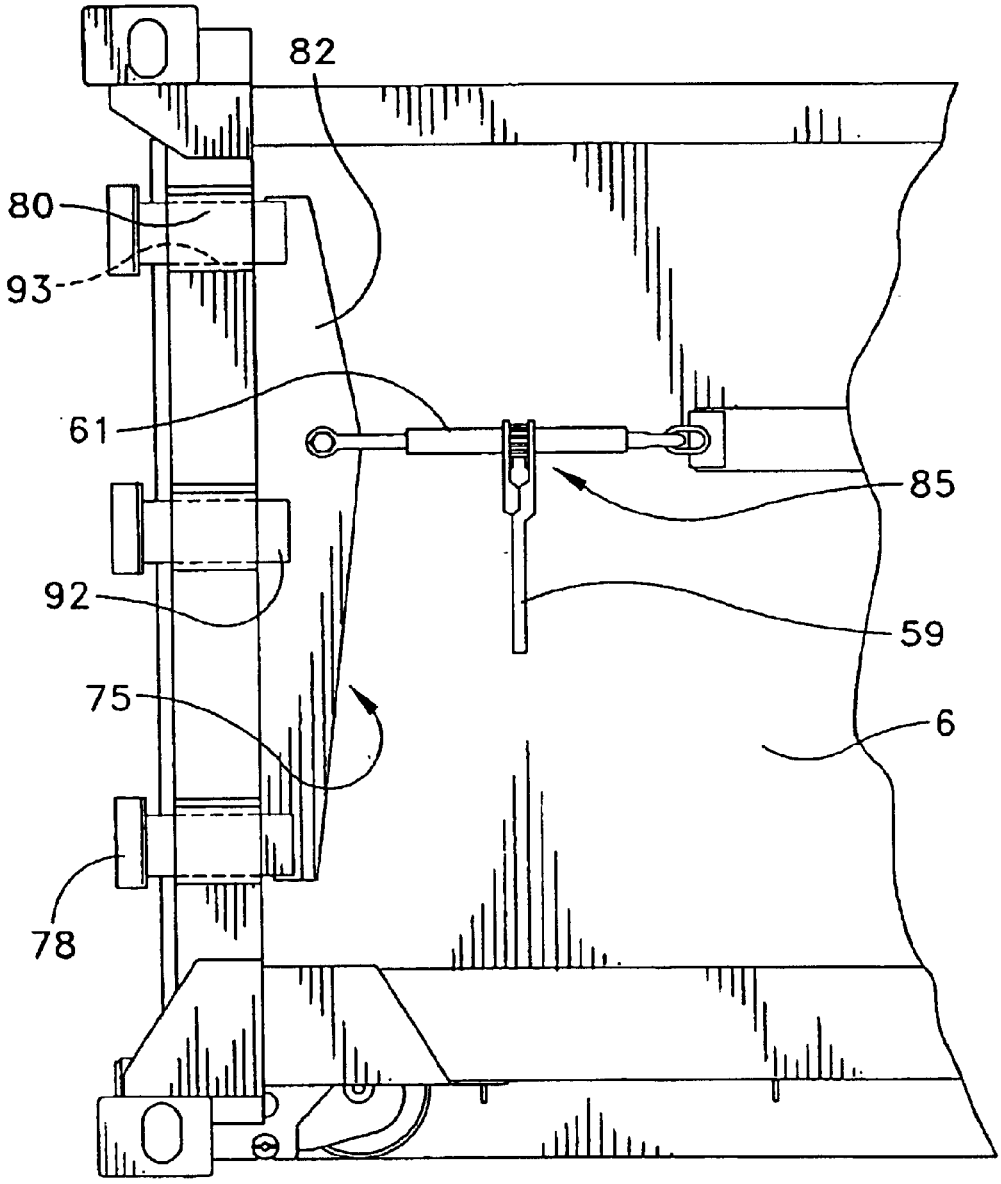
FIG. 9 is a broken-away, side elevational view of a hinge assembly formed according to the embodiment of the invention shown in FIG. 7.

Container 1 is typically made of a high structural strength material, such as steel or the like, and can be rectilinearly shaped, e.g., having a rectangular profile in plan, as well as side and end elevation. Other shapes, including arbitrary shapes, and other materials are possible. Top wall 13 defines an opening and includes a movable panel or lid 20 that is sized to cover and sealingly close the opening. Lid 20 is typically rectilinear, and occupies nearly the full width and a portion of the length of the top of the container. A lip 15 projects upwardly from top wall 13 around the perimeter of the opening facing lid 20, and is preferably formed from a yieldable seal material, e.g., an elastomeric seal, (FIGS. 4 and 5). It is also possible to place the seal on the lid rather than the lip, or to provide both the lid and the lip with a seal.

Lid 20 is preferably rectilinearly shaped, and has a support frame 22 and a cover sheet 23. These can be constructed of light-weight materials so as to be easily moved by hand or low-power motor. For example, the lid components can comprise aluminum sheet material and rectangular tubing. The lid can be constructed to define an arc or crown whereby the sheet material is rounded downwardly and outwardly slightly to shed water. An annular seal receptacle 19 may be located on its bottom surface, adjacent to its peripheral edges, and positioned in corresponding relation to lip 15 of top wall 13. Annular seal receptacle 19 is sized and shaped to house an elastomeric gasket or seal 18. In its broadest aspects, the invention provides at least one wall (typically rear wall 10 or lid 20) that is arranged so as to be movable first outwardly from sealing engagement, in a direction perpendicular to the central volume and the plane of the closure leading thereto, and then either slides or is pivoted while thus disengaged from the seal, so as to provide gross access and egress to and from the central volume. In this way the movable wall or lid can be moved between a closed and substantially sealed position and a closed and substantially unsealed position, prior to being moved to a fully open position so as to form an entrance into the volume. As a result, wear on the seal is minimized.

Referring to FIGS. 1–6, an embodiment of the invention is shown wherein a carriage assembly 30 is mounted to the lateral underside edges of lid 20, carried on displaceable guide tracks 35A, 35B, that are mounted on top wall 13 of container 1. Carriage assembly 30 and displaceable guide tracks 35A, 35B cooperate with one another to enable lid 20 to move between a closed and substantially sealed position and a closed and substantially unsealed position (FIGS. 4 and 5). More particularly, carriage assembly 30 includes a plurality of rollers 42 that are mounted to individual axles 41 on a frame 44. Frame 44 comprises a support beam 46 and a pivot rod 48. Pivot rod 48 extends outwardly from support beam 46 and preferably is substantially centrally located under lid 20. A pivot socket 49 is provided in frame 22, and is located on each lateral edge of lid 20. Pivot socket 49 is sized and shaped to pivotally receive pivot rod 48. In this way, rollers 42, frame 44, and lid 20 cooperate with guide tracks 35A, 35B to be moved in unison laterally across top wall 13 of container 1 to expose the opening to the central volume. It will be understood that rollers 42 may comprise wheels of any type, or a non-rolling, i.e., sliding, mechanism may be used that provides for low-friction movement of carriage assembly 30 along guide tracks 35A, 35B.

Displaceable guide tracks 35A, 35B are movably mounted adjacent to the edges of the opening in top wall 13, with each including a track 50, a collar 52, at least two shafts 55, and at least two ratchet-binders 57. Each track 50 has an elongated rail or the like having a cross-sectional shape that is complementary to the outer profile of rollers 42. For example, in one embodiment track 50 comprises an inverted angle iron having an orientation and shape that complements a gap or spacing in "V"-groove rollers 42 (FIGS. 4 and 5). In this way, rollers 42 of carriage assembly 30 are confined to roll along and be guided by track 50, and tend to resist racking because gravity urges the rollers to center themselves laterally on the angle iron rail. Collar 52 is a generally open-ended, channel-shaped structure including an upper sidewall 62, a lower sidewall 64, and a web 66. Track 50 is mounted on the inside surface of lower sidewall 62, and collar 52 is oriented so that track 50 is accessible to rollers 42 of carriage assembly 30. In other words, collar 52 is oriented so that rollers 42 may be placed in rolling engagement with track 50, with frames 44 positioned between collar 52 and lid 20.

Figure 2:
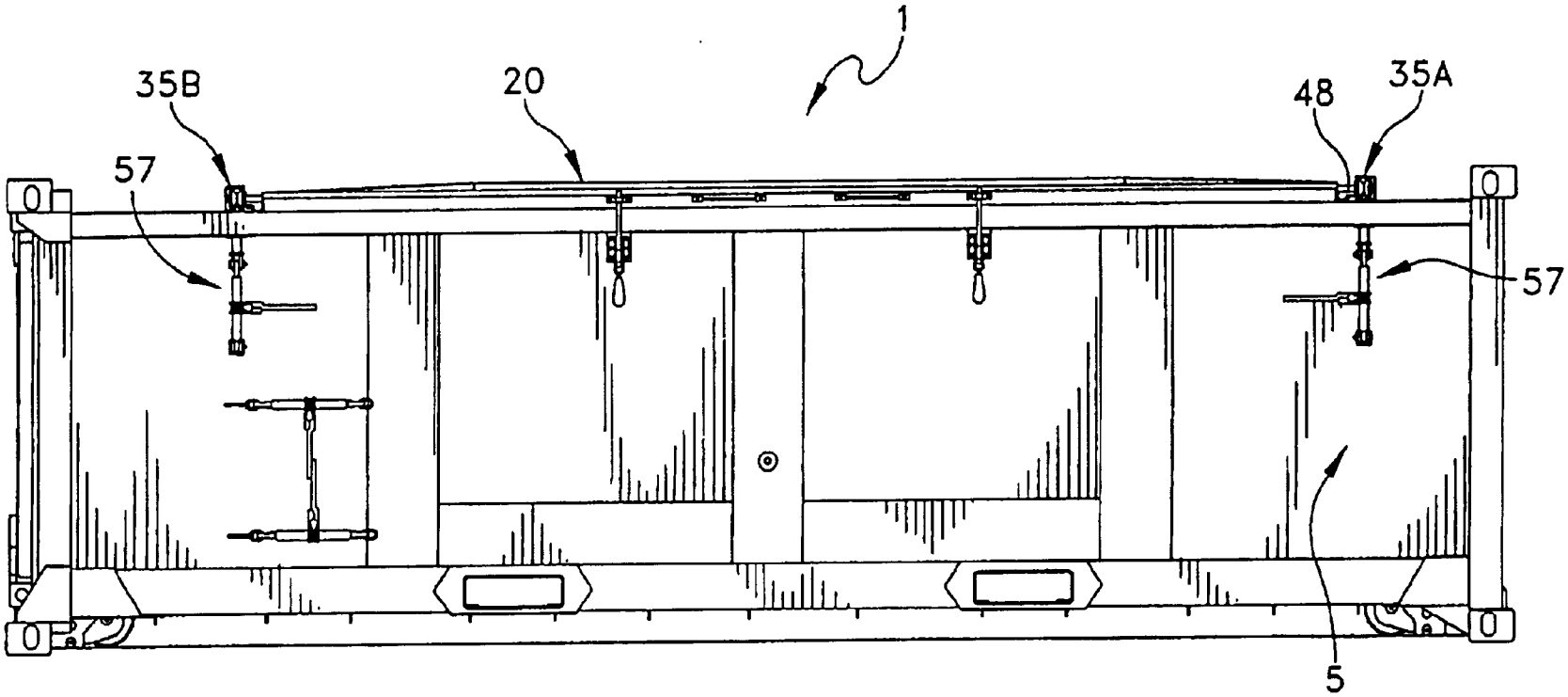
FIG. 2 is a side elevational view of the container shown in FIG. 1.
Figure 3:
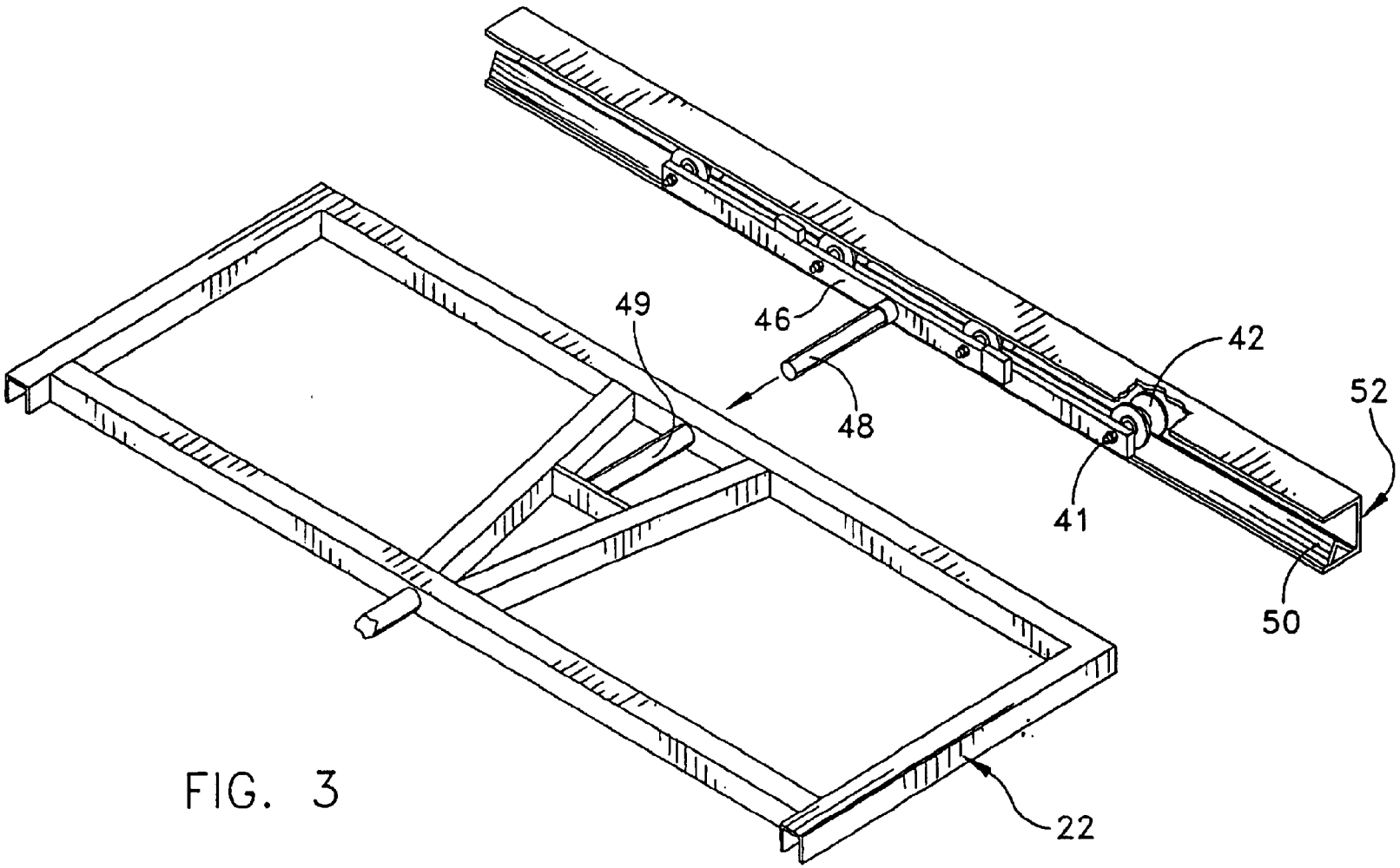
FIG. 3 is a perspective view of a carriage assembly, guide track, and a portion of a lid frame structure.

Referring to FIGS. 2, 4, and 5, each shaft 55 projects downwardly from the bottom surface of lower sidewall 64, and through an opening defined in a flanged edge portion of top wall 13. Shaft 55 operatively engages a ratchet-binder 57 mounted on the outside surface of sidewalls 5 and 6. Ratchet binders 57 are of the type that are well known in the art for applying or releasing a measured and regulated amount of tension to a binding member, such as a rope, cable, shaft, or the like, by converting rotational movement driven by ratcheting or reciprocating a handle 59, into extension or retraction of a shaft and eyelet member 61. Typically, handle 59 is interconnected to a ratcheted gear assembly 65, including a direction control switch mechanism, which allows for the application or release of tension with the same ratcheting movement of handle 59, depending upon the state of the switch.

As a result of this construction, when ratchet binder 57 is operated so as to extend member 61, shaft 55 moves upwardly lifting collar 52 off of top wall 13 and thereby lifting carriage assembly 30 and lid 20 upwardly and away from top wall 13 by means of the "V"-shaped rollers. As this occurs, seal 18 is disengaged from annular seal receptacle 19, placing lid 20 and carriage assembly 30 in an unsealed position where it is free to be moved laterally, across top wall 13 so as to expose the opening into containers 1. The upward progress of shaft 55 may be halted by either stopping actuation of ratchet binder 57 or by engagement of a stop plate on the shaft with the peripheral underside edge of top wall 13. Once lid 20 is moved across top wall 13 by a predetermined distance, lid 20 may be pivoted upwardly, from one end, about pivot rod 48, in a known manner, such that the lid resides on the container side wall entirely clear of the opening. Preferably the lid is bidirectionally movable in this manner, whereby the lid can be displaced to and pivoted upwardly alongside either of the opposite container sidewalls.

A reversal of the foregoing procedure lowers lid 20 onto top wall 13 and re-engages seal 18 in annular seal receptacle 19. More particularly, lid 20 is slid laterally across top wall 13 by a predetermined distance so as to place lid 20 directly over top of the opening in the container. Preferably the rails are provided with depressions forming detents for the "V"-rollers at a position in which the lid 20 is aligned with the opening in the container. Ratchet binder 57 is then operated so as to retract member 61, moving shaft 55 downwardly, and lowering collar 52 onto top wall 13. In this way, carriage assembly 30 and lid 20 are lowered substantially perpendicularly downwardly and toward top wall 13. As this occurs, seal 18 re-engages annular seal receptacle 19. In this way, lid 20 can be moved between a closed and substantially sealed first position (with seal 18 engaged in annular seal receptacle 19) and a closed and substantially unsealed second position (with seal 18 disengaged from annular seal receptacle 19) prior to being moved to a fully open position so as to form an entrance into the volume of container 1. According to the structure shown, "V"-rollers 42 are captive in guide rails 35A, 35B, namely between track 50 and upper sidewall 62. Thus, foreshortening the ratchet binders not only permits the lid and seal to engage by gravity, but also can be used to pull the lid downwardly against the seal. This securely locks and seals the lid in place.

Referring to FIGS. 1 and 7–9, another embodiment of the present invention is shown, this time in connection with an end or rear wall 10. Rear wall 10 is movably mounted to the end of container 1 by a rear carriage assembly 75 comprising at least two hinges 78, a hinge guide 80, a hinge transfer plate 82, and a rear ratchet binder 85. Hinges 78 are of a conventional design, and are preferably of the type normally used for intermodal container doors. Each hinge 78 includes a door mount 88 and a wall mount 91 that are pivotally interconnected at their intersection. Door mount 88 is fixedly attached to rear wall 10 and wall mount 91 is fixedly attached to hinge transfer plate 82. Wall mounts 91 comprise beams that are sized and shaped to be slidingly received within correspondingly shaped passageways 93 defined through hinge guide 80. Passageways 93 are defined transversely through each hinge guide 80 in equi-spaced relation to one another along the length of hinge guide 80. Hinge transfer plate 82 is substantially planer in shape, and has each wall mount 91 fastened to it along an edge adjacent to hinge guide 80, with rear ratchet binder 85 fastened to it at a central location along the edge that is spaced from hinge guide 80.

Hinge transfer plate 82 and the plural spaced hinge wall mounts 91 are rigidly attached to plate 81. The hinge wall mounts 91, each of which forms one of the leaves of a hinges 78 and are constrained to move only along parallel tracks defined by hinge guides 80, form a hinge mounting structure that is only capable of moving in a direction perpendicular to the closure plane of the end wall or door 10, namely in a plane parallel to sidewall 6. Whereas the hinge wall mounts 91 move as a unit and remain guided in hinge guides 80, it is possible to displace the pivot axis of the end wall or door perpendicular to the closure plane. However the structure does not permit the uppermost hinge wall mount 91, for example, to be advanced outwardly any farther than the lowermost hinge wall mount 91. This structure thereby resists the tendency of the cantilevered weight of the door to droop due to the freedom of the hinge axis to move inwardly and outwardly perpendicular to the plane of the closure.

Ratchet binder 85 is of the same type as ratchet binder 57, i.e., of the type that is well known in the art for applying or releasing a measured and regulated amount of tension to a binding member, such as a rope, cable, shaft, or the like, by converting rotational ratcheting movement of a handle 59 into an extension or retraction of a shaft and eyelet member 61. Ratchet binder 85 is fastened to hinge transfer plate 82 by eyelet member 61 (FIG. 9) and to sidewall 6 of container 1. As a result of this construction, hinge transfer plate 82 is movable between a first fully retracted position and a second fully extended position. Movement between the first and second positions enables door or rear wall 10 to shift between a closed and substantially sealed position and a closed and substantially unsealed position. More particularly, as ratchet binder 85 is actuated, so as to move hinge transfer plate 82 toward hinge guide 80, hinges 78 move outwardly and longitudinally away from the central volume of container 1. In this way, rear wall 10 is moved outwardly and away from sidewalls 5, 6, top wall 13 and the bottom of container 1. Once rear wall 10 is in its second position, it is free to pivot about hinges 78 and swing open and closed for entrance and egress to and from container 1.

In addition to the depicted mounting on the hinge side of door or end wall 10, a latch mechanism (not shown) can be provided on the container side wall opposite from the hinge side, and another ratchet binder (also not shown) can be provided on that side to urge the distal or free side of the door toward the closure plane. The latch mechanism can include an inclined plane block that receives a latch pin block protruding from the free edge of the door to provide additional vertical support. In addition, lower edge clamps can be provided to pivot against the bottom edge of the door panel in known manner.

According to each of the embodiments of the invention, a fine or final displacement is provided for moving a closure panel into (or out of) engagement with the seal from a closed-but-unsealed position at which the closure panel is free of interference with or from the seal. This displacement involves mountings that constrain the motion of the closure panel to a direction perpendicular to the plane of the closure. From this closed-but-unsealed position, the closure panel can operate in a coarse but durably configured manner and can comprise heavy duty component parts that can readily bear stresses placed on the container in use.

Referring to FIGS. 10–15, rear wall or door 10 is often arranged so as to effect a sealed engagement with a door frame header 90 positioned on the rear edges of side walls 5 and 6, top wall 13 and the bottom of container 1. In this embodiment, a channel-shaped seal receptacle 92 is located on door frame header 90, in surrounding relation to the opening defined by side walls 5 and 6, top wall 13 and the bottom of container 1. Seal receptacle 92 is sized and shaped to house an elastomeric gasket or seal 95.

Figure 13:
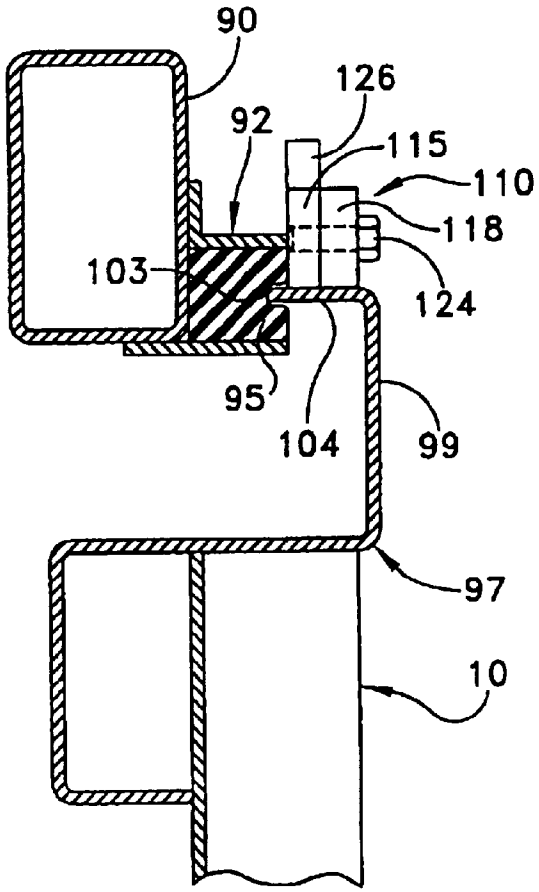
FIG. 13 is a cross-sectional view of a door, as taken along the lines 13—13 in FIG. 12.
Figure 15:
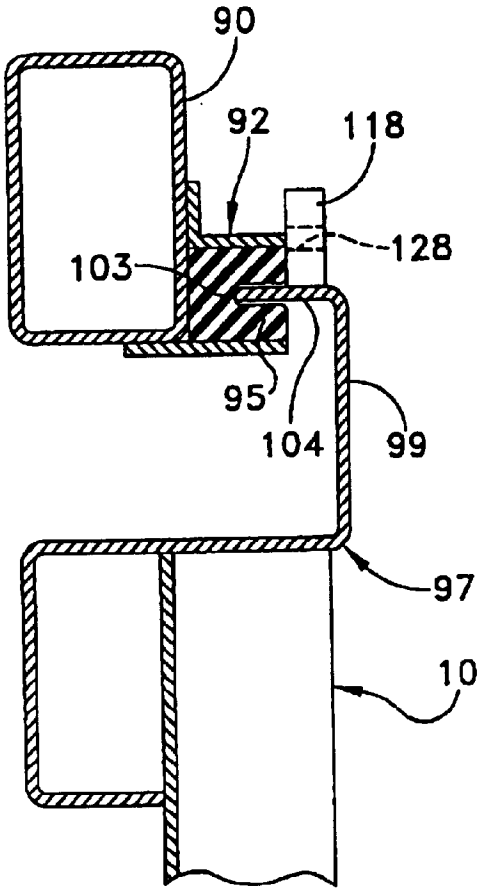
FIG. 15 is a cross-sectional view of a door, as taken along the lines 15—15 in FIG. 12.
Figure 14:
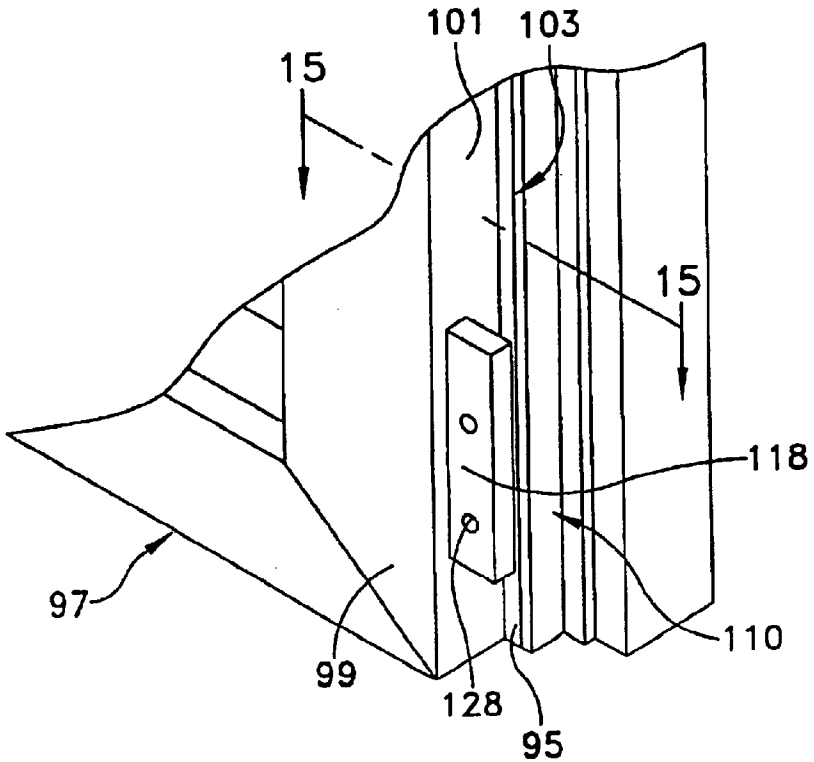
FIG. 14 is a broken away comer of a door, including the adjustable door stop assembly of the present invention.

Door 10 includes a peripheral frame 97 comprising a face-wall 99 and a seal-wall 101 having a knife-edge 103. Seal-wall 101 projects inwardly, toward container 1, in substantially perpendicular relation to face-wall 99 when door 10 is in its first and second positions, as described herein above in more detail. In this way, when door 10 is moved between its second and first positions, i.e., from a closed and substantially unsealed position to a closed and substantially sealed position, knife-edge 103 of seal-wall 101 is arranged in aligned, confronting relation to elastomeric seal 95 within seal receptacle 92. As door 10 moves into its second position, knife-edge 103 engages and depresses elastomeric seal 95, thus fonning a releasable, fluid tight seal between door 10 and door frame header 90 (FIGS. 13 and 15).

Figure 10:
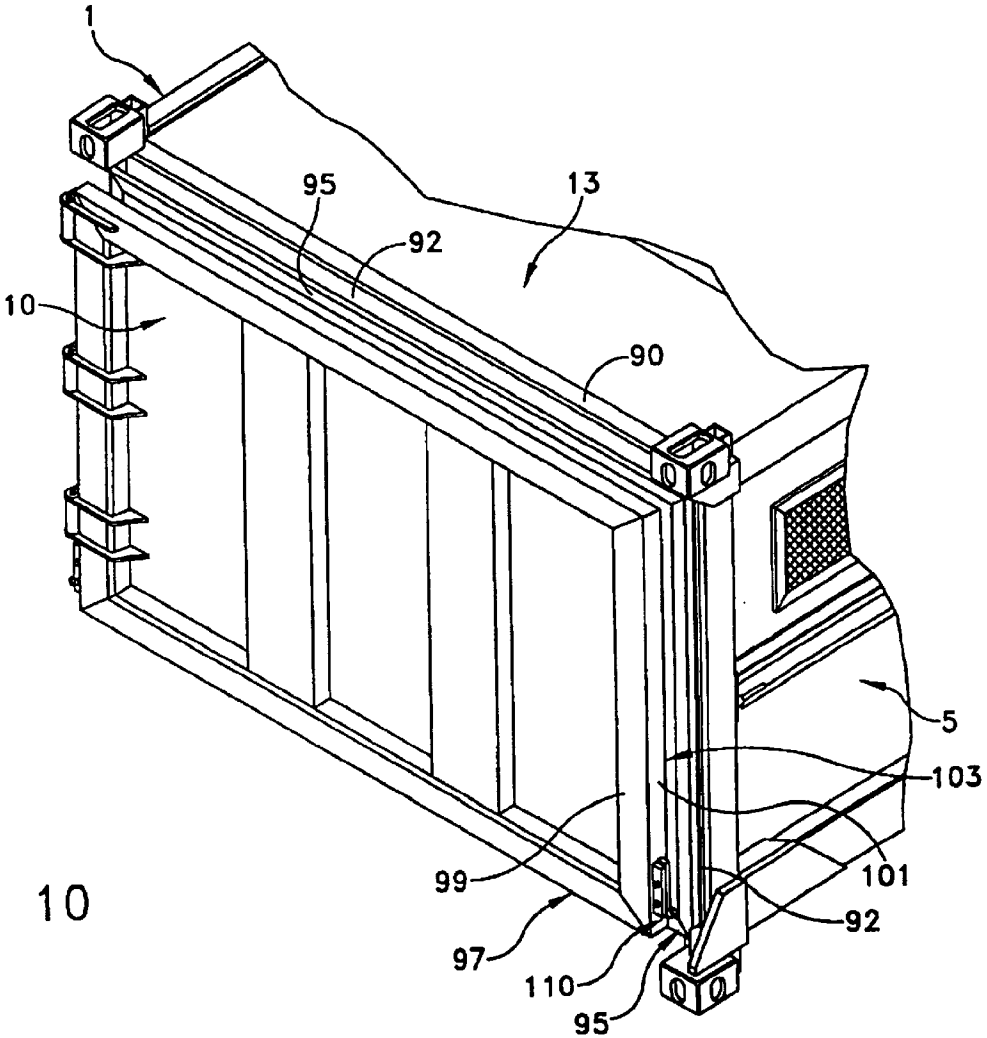
FIG. 10 is a perspective view, partially broken away, of an alternative embodiment of a container formed in accordance with the present invention.
Figure 11:
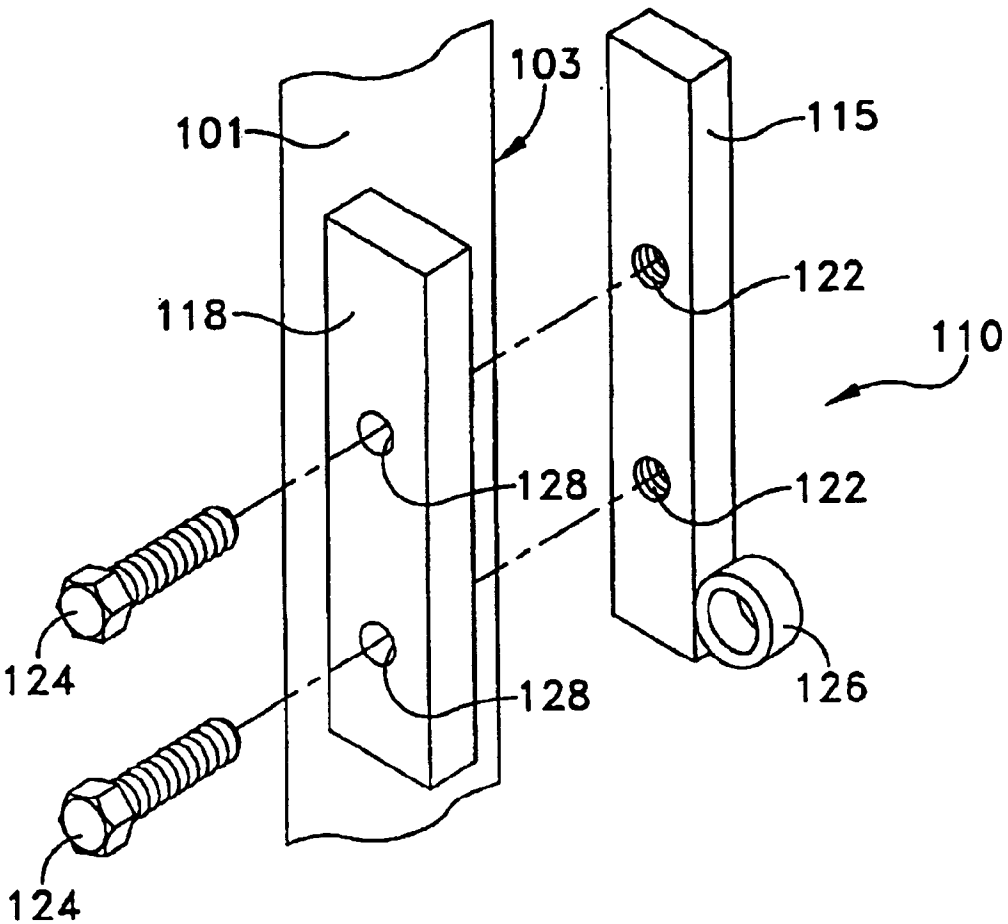
FIG. 11 is a broken away, exploded perspective view of an adjustable door stop assembly formed in accordance with the present invention.
Figure 12:
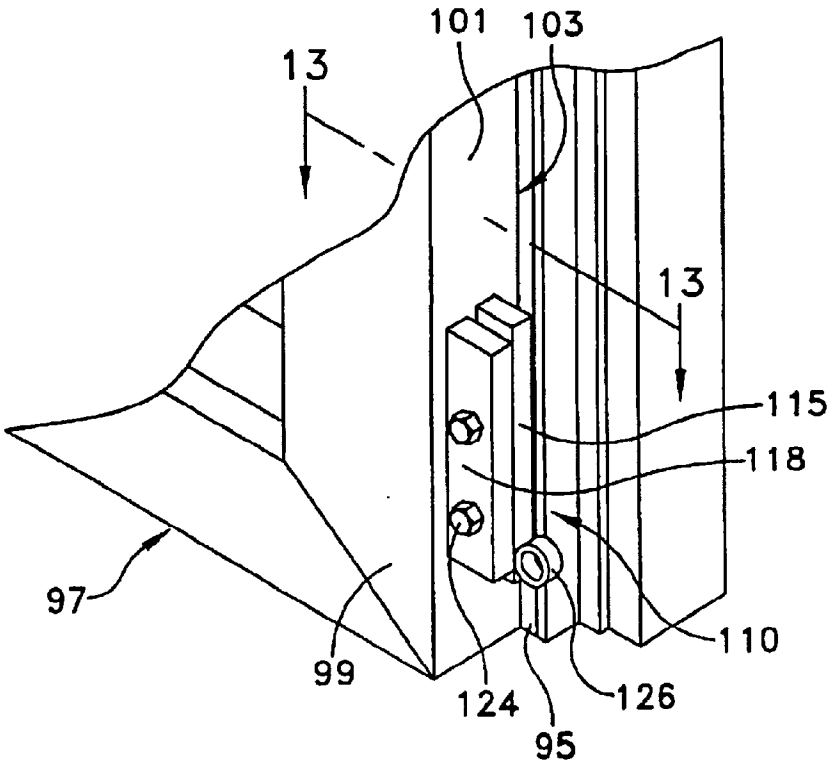
FIG. 12 is a broken away comer of a door, including the adjustable door stop assembly of the present invention.

After repeated sealing and unsealing of door 10, elastomeric seal 95 degrades, resulting in an insufficient seal that often causes unacceptable leakage of fluids from container 1. In order to prevent such leakage and to alert an operator of such a worn seal condition, one or more adjustable door stop assemblies 110 are mounted on seal-wall 101 adjacent to knife-edge 103 (FIGS. 10 and 12). More particularly, each adjustable door stop assembly 110 comprises a removable stop blade 115 and a fixed stop blade 118 (FIG. 11). Removable stop blade 115 is formed from an elongate block of material, often metal, and includes one or more threaded through-bores 122 and a pull-ring 126. Removable stop blade 115 is often between about one-half inch (0.5") and about one inch (1") in thickness, although other lesser or greater thickness will function adequately. Pull-ring 126 is positioned on an outer peripheral edge of removable stop blade 115, and is sized and shaped to receive a bar, hook, or the like prying tool. Of course, pull-ring 126 need not be annular or circular in shape, but may comprise a variety of shapes that are suitable for tensile engagement with a secondary tool. Fixed stop blade 118 is also formed from an elongate block of material, often metal, and includes one or more through-bores 128. Fixed stop blade 118 is often also between about one-half inch (0.5") and one inch (1") in thickness, with other thicknesses possible. Through bores 122, 128 are sized to receive fasteners, such as bolts 124.

Adjustable door stop assembly 110 is assembled to door 10 in the following manner. Fixed stop blade 118 is positioned adjacent to the outer surface of seal-wall 101 where it is securely fastened to seal-wall 101 by welding or the like, along one edge. In this way, fixed stop blade 118 stands proud of the surface of seal-wall 101 with through-bores 128 arranged in substantially parallel relation to seal-wall 101. Removable stop blade 115 is then positioned adjacent to fixed stop blade 118 such that threaded through-bores 122 are positioned in aligned coaxial relation with through-bores 128 of fixed stop blade 118. In this position, pull-ring 126 projects outwardly, in spaced relation to seal-wall 101, so as to be easily accessed and engaged by a tool. Once in this position, bolts 124 are engaged within through-bores 128, 122, so as to releasably fasten removable stop blade 115 to fixed stop blade 118.

When an operator or inspector notices that elastomeric seal 95 has degraded, or is providing for an insufficient seal such that unacceptable leakage of fluids or debris from container 1 is occurring, the operator or inspector merely unfastens bolts 124, and inserts a suitable prying device through pull-ring 126. Once in this position, the operator or inspector pulls on pull-ring 126 so as to remove removable stop blade 115 from its position adjacent to fixed stop blade 118. As a result of this change in construction of adjustable door stop assembly 110, knife-edge 103 of seal-wall 101 may penetrate elastomeric seal 95 by an amount substantially equal to the thickness of removable stop blade 115. In this way, an additional amount of sealing integrity is achieved between seal-wall 101 and elastomeric seal 95. It should be noted that, when an operator or inspector recognizes that removable stop blade 115 and pull-ring 126 are no longer present on adjustable door stop assembly 110, it is an appropriate time for replacing elastomeric seal 95.

Referring to FIGS. 16–23, when container 1 is fully loaded with refuse it must be tipped on end, with door 10 fully opened so that the contents can slide out. Often, a negative pressure is developed that impedes the movement of that refuse from within the container. In order to alleviate this problem, a pressure release assembly 125 is provided in a side panel 126 of either of side walls 5,6.

Figure 16:
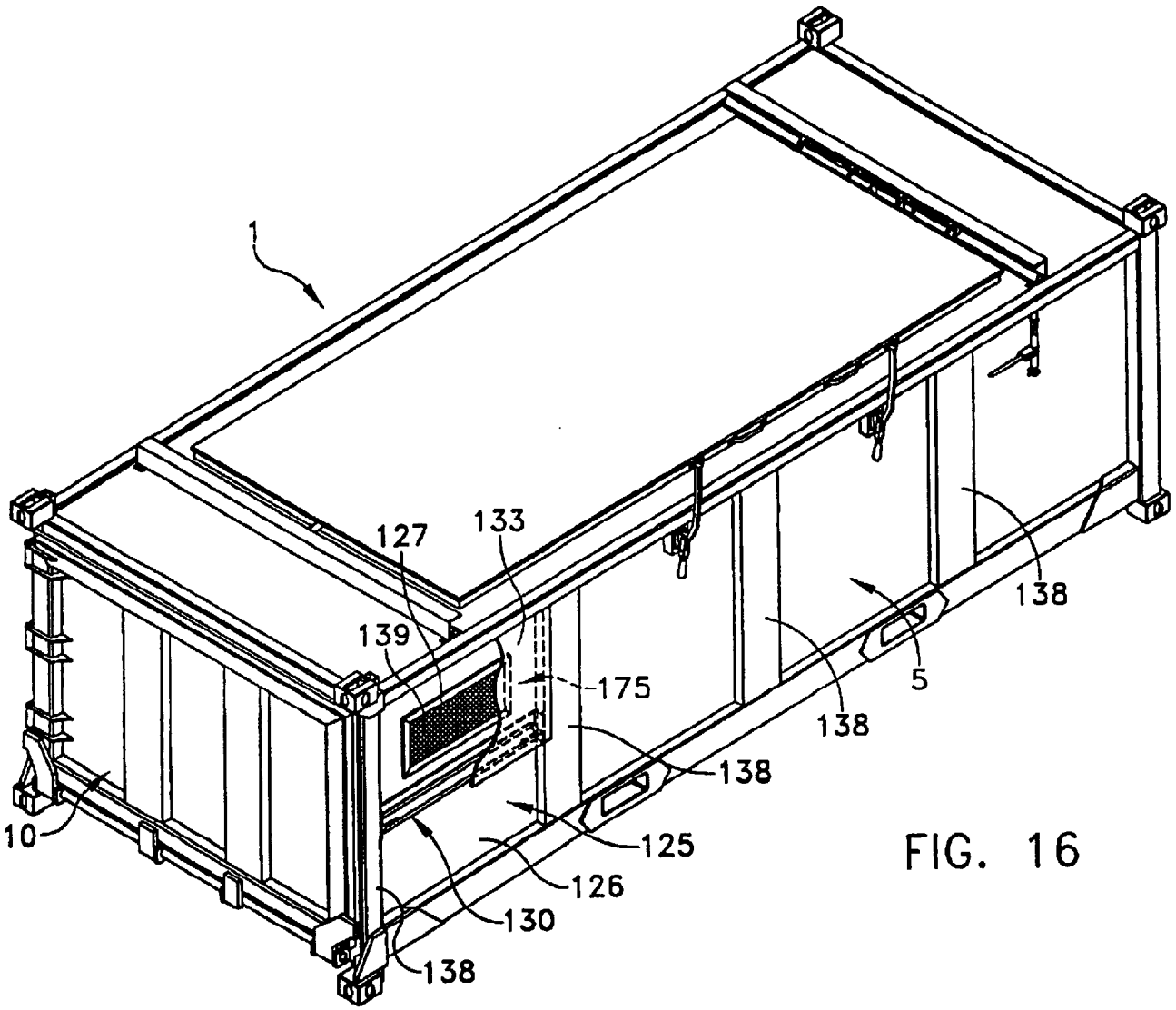
FIG. 16 is a perspective view of a further embodiment of a container formed in accordance with the present invention.
Figure 17:
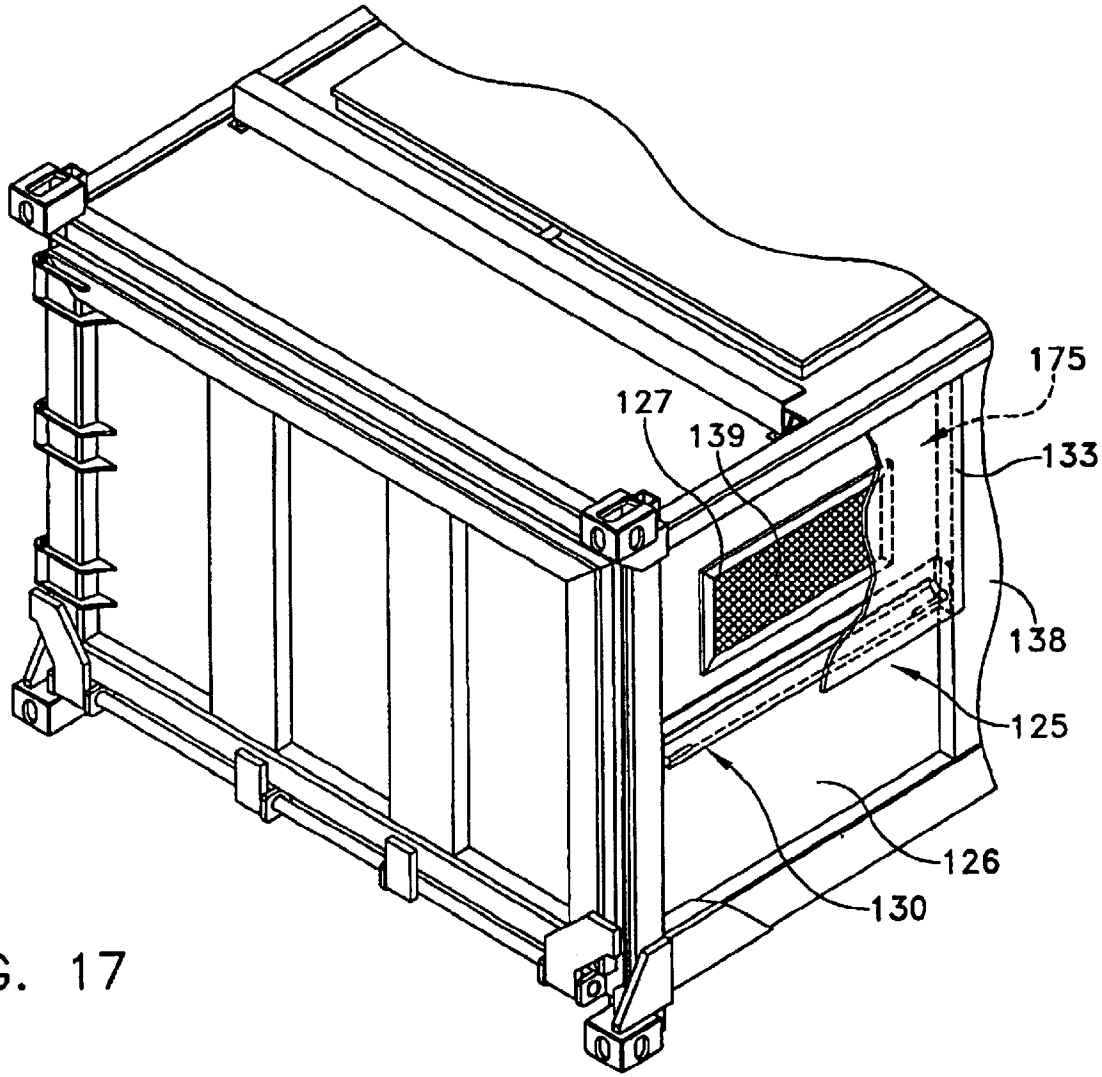
FIG. 17 is a broken away perspective view of a container formed in accordance with the present invention, including a pressure relief assembly.

More particularly, pressure release assembly 125 comprises a vent panel 127, a flapper assembly 130, and a cover plate 133 (FIGS. 16 and 17). Vent panel 127 is positioned within a recessed portion of side walls 5 or 6, between adjacent vertical support columns 138, and provides for air flow communication between the interior of container 1 and the environment adjacent to the side wall of the container. A mesh, screen, or other perforated barrier 139 is often positioned within vent panel 127 so as to prevent egress of most refuse from the interior of container 1. It should be noted that occasionally some smaller sized pieces of refuse (shown generally at reference numeral 135 in FIG. 23) will exit container 1 through vent panel 127.

Figure 18:
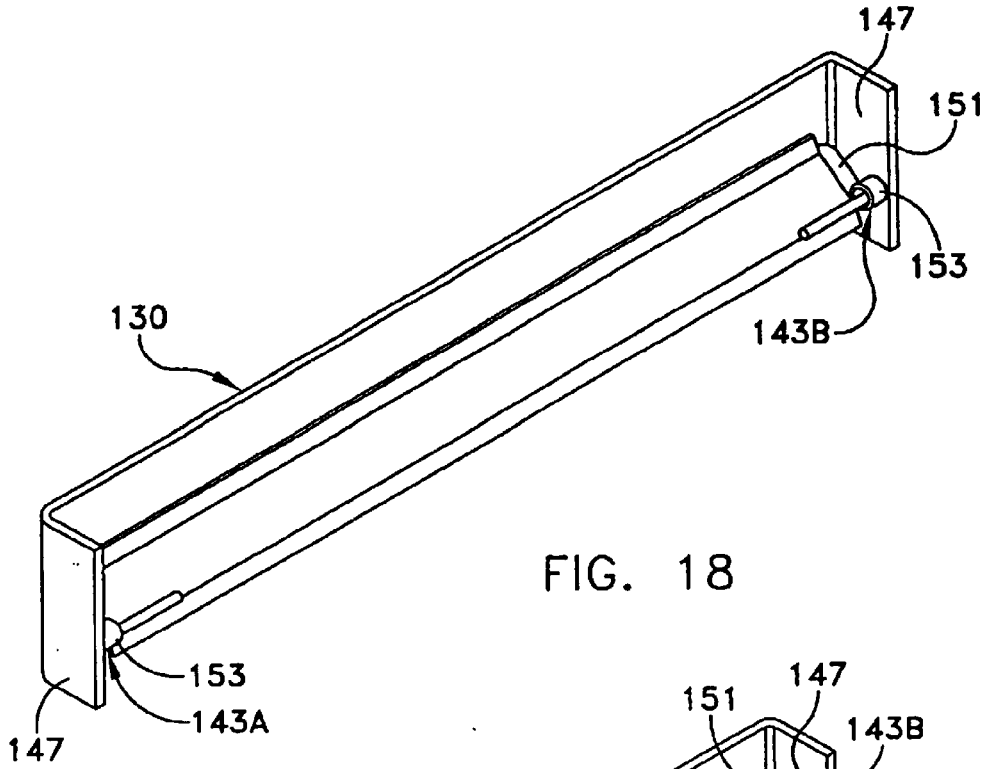
FIG. 18 is a perspective view of a flapper assembly.
Figure 19:
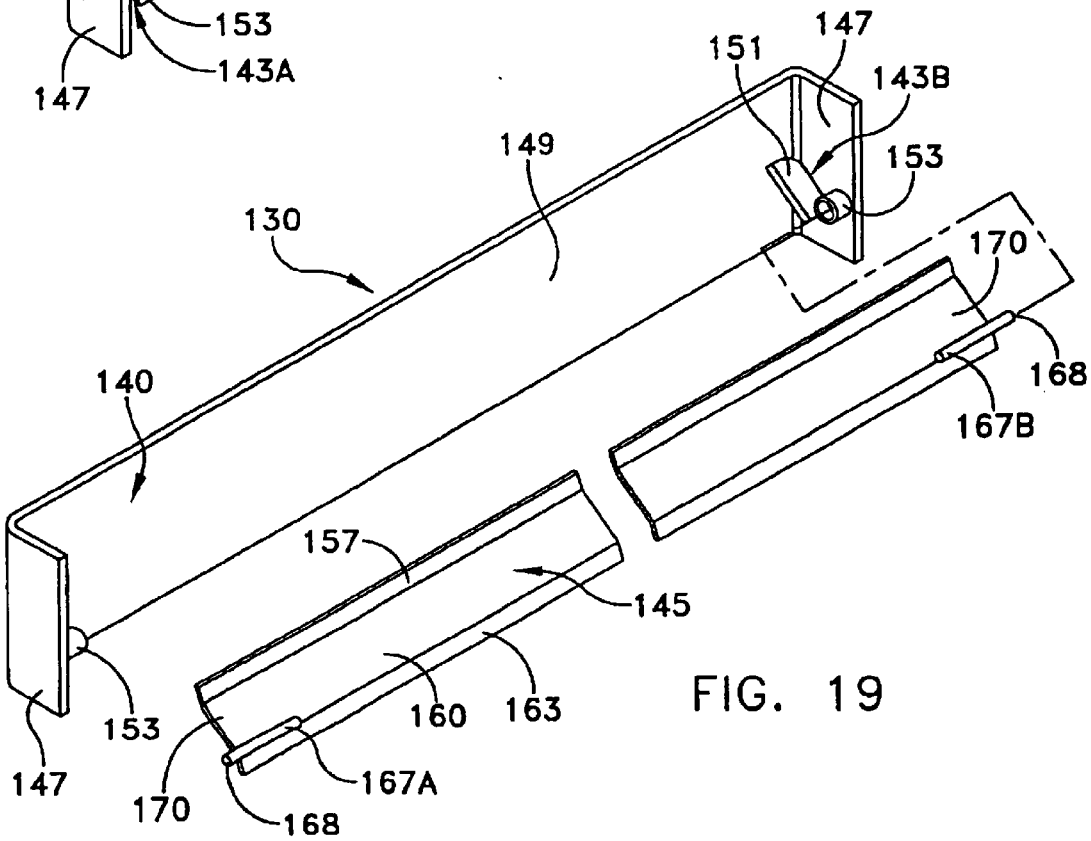
FIG. 19 is an exploded view of the flapper assembly shown in FIG. 18.

Referring to FIGS. 18 and 19, flapper assembly 130 includes a support bracket 140, two pivot supports 143A, 143B, and a flapper-plate 145. Support bracket 140 comprises a channel-shaped plate having a pair of flanges 147 positioned at each end of a central web 149. Support bracket 140 is typically sized so that when it is positioned on side panel 126, flanges 147 will engage the confronting inner surfaces of opposed vertical support columns 138 so as to facilitate fastening by, e.g., welding or the like. Pivot supports 143A, 143B are positioned on the inner surfaces of flanges 147 in spaced confronting relation to one another. Each pivot support 143A, 143B includes a rest-plate 151 and a pivot-socket 153. Pivot supports 143A, 143B are arranged on the inner surfaces of flanges 147 such that pivot-sockets 153 are arranged in coaxially aligned spaced confronting relation to one another, with each rest-plate 151 projecting outwardly from the inner surface of flange 147. Pivot-sockets 153 are arranged at a lower edge of rest-plates 151, with rest-plates 151 extending upwardly from sockets 153 in an inclined relation to flange 147 and central web 149.

Flapper-plate 145 comprises an upper sealing flange 157, a central plate 160, and a lower sealing flange 163. A pair of pivot shafts 167A and 167B are arranged in spaced apart colinear relation on central plate 160, adjacent to an upper edge of lower sealing flange 163. A free end 168 of each pivot shaft 167A, 167B projects outwardly from an edge of flapper-plate 145. Upper sealing flange 157 and lower sealing flange 163 are angled relative to central plate 160. In particular, upper sealing flange 157 defines an angle with respect to central plate 160, of less than 180°, but more than 90°. Lower sealing flange 163 defines an angle, with respect to central plate 160, of greater than 180°, but less than 270°. In this way, a substantial sealing engagement can be achieved between an edge of upper sealing flange 157 and a confronting portion of side panel 126, and between an edge of lower sealing flange 163 and a confronting portion of cover plate 133.

Figure 20:
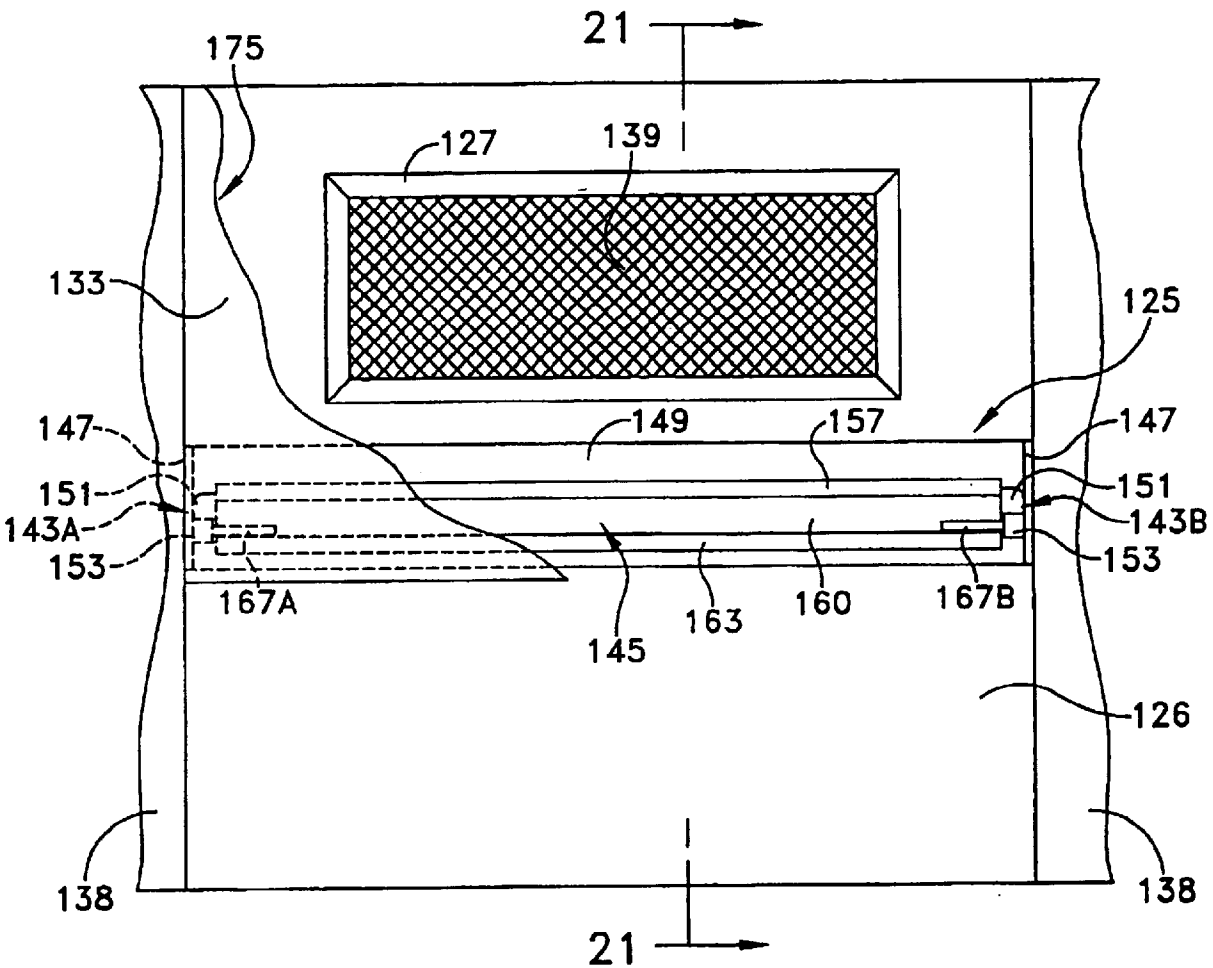
FIG. 20 is a broken away front elevational view of the pressure relief assembly of the present invention.
Figure 21:
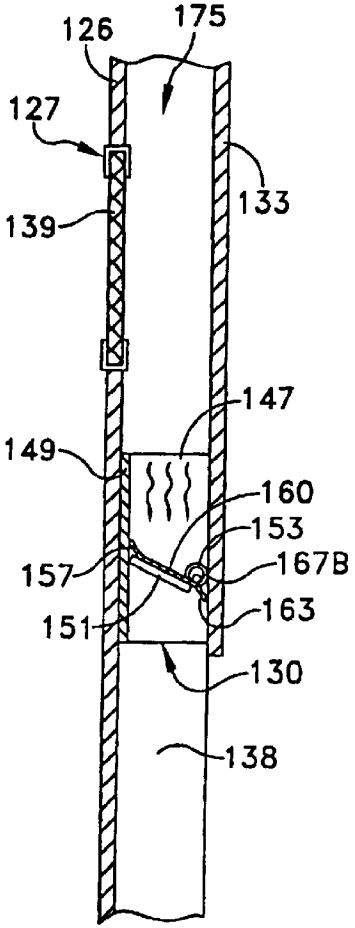

Flapper-plate 145 is assembled to support bracket 140 by inserting the free ends 168 of pivot shafts 167A, 167B into sockets 153 of pivot supports 143A, 143B so that an end edge portion 170 of central plate 160 engages an outer surface of rest-plates 151. In this position, the entire outer edge of upper sealing flange 157 engages central web 149. Flapper assembly 130 is fastened to panel 126 of container 1, e.g., by welding or the like, adjacent to the lower edge of vent panel 127 (FIGS. 16, 17, and 20). Cover plate 133 comprises a planer sheet of material, e.g., metal or the like, and is positioned in confronting relation to vent panel 127 and flapper assembly 130. Cover plate 133 is sealingly fastened along its peripheral edges to the outer surfaces of vertical columns 138 and the outer edge of top 13. In this position, the entire outer edge of lower sealing flange 163 of central plate 160 engages the lower inner surface of cover plate 133. In this way, cover plate 133, central web 149, and flapper-platel 45 define a partially sealed chamber 175 on side wall 5 that is in air-flow communication with the interior of container 1 through perforated barrier 139 in vent panel 127 (FIG. 21).

Figure 22:
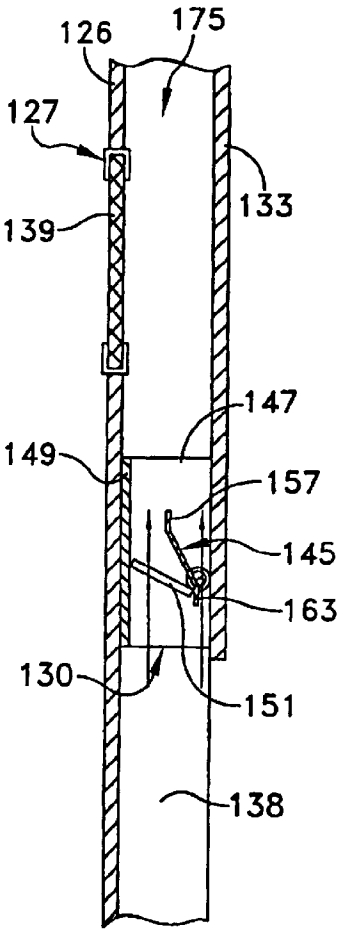

Flapper assembly 130 acts to relieve the negative pressure generated by refuse leaving container 1 in the following manner. As negative pressure is created within container 1, partially sealed chamber 175 also experiences that same negative pressure, via the air-flow communication with the interior of container 1. This causes a differential in air pressure between the outside environment and partially sealed chamber 175, i.e., the air pressure within partially sealed chamber 175 is less than the air pressure in the environment surrounding container 1. As a consequence of this difference in air pressure, flapper-plate 145 will tend to pivot upwardly about pivot shafts 167A, 167B within sockets 153, thereby allowing ambient air to enter partially sealed chamber 175, and container 1 via vent panel 127, so as to equalize the air pressure within container 1 with the surrounding ambient environment air pressure (FIG. 22).

Figure 23:
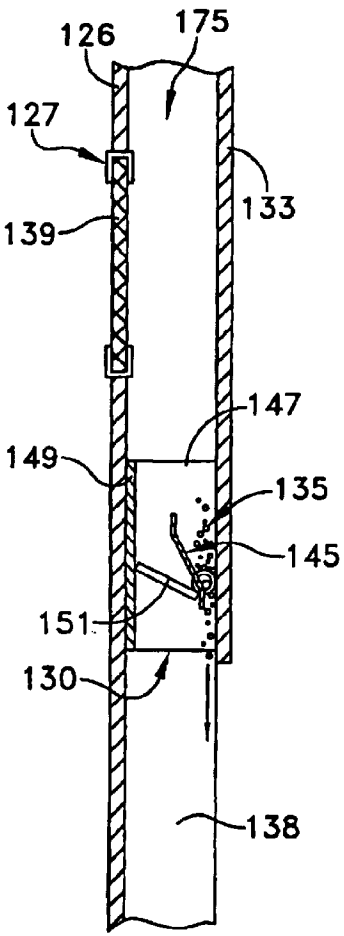
FIGS. 21, 22, and 23 are each a cross-sectional view of the pressure relief assembly shown in FIGS. 1 and 20, as taken along lines 21—21 in FIG. 20, showing the operation, in stages, of the pressure relief assembly of the present invention.

Significantly, as flapper-plate 145 rotates within sockets 153, any debris or refuse 135 that has collected on the top of flapper-plate 145 will exit through the gap formed as lower sealing flange 163 moves away from the inner surface of cover plate 133 (FIG. 23).

The invention has been described with respect to certain preferred embodiments, but the invention is not limited only to the particular constructions disclosed and shown in the drawings as examples, and also comprises the subject matter and such reasonable modifications or equivalents as are encompassed within the scope of the appended claims.

What is claimed is:

1. A container door comprising a peripheral frame having an elongate side surface and an edge; and an adjustable door stop assembly including a first stop blade comprising a discrete block that is fixedly fastened to said side surface of said peripheral frame so as to be in spaced relation to said edge; and a second stop blade comprising a discrete block that is removably fastened to said first stop blade between said first stop blade and said edge.

2. The container door according to claim 1 wherein said first stop blade is elongate and includes at least one through-bore.

3. The container door according to claim 1 wherein said second stop blade is elongate and includes at least one through-bore and a pull-ring fastened to an edge of said discrete block forming said second stop blade and positioned in spaced relation to said edge.

4. The container door according to claim 1 wherein said first stop blade is between about one-half inch and about one inch in thickness.

* * * * *